US008811881B2

(12) United States Patent
Nishida

(10) Patent No.: US 8,811,881 B2
(45) Date of Patent: Aug. 19, 2014

(54) CLEANING DEVICE AND IMAGE FORMING APPARATUS

(75) Inventor: Satoshi Nishida, Saitama (JP)

(73) Assignee: Konica Minolta, Inc., Tokyo (JP)

( * ) Notice: Subject to any disclaimer, the term of this patent is extended or adjusted under 35 U.S.C. 154(b) by 275 days.

(21) Appl. No.: 12/893,869

(22) Filed: Sep. 29, 2010

(65) Prior Publication Data

US 2011/0081177 A1 Apr. 7, 2011

(30) Foreign Application Priority Data

Oct. 5, 2009 (JP) ..... 2009-231186

(51) Int. Cl.
*G03G 21/00* (2006.01)

(52) U.S. Cl.
USPC ..... 399/346; 399/349; 399/350

(58) Field of Classification Search
USPC ..... 399/71, 343, 346, 349
See application file for complete search history.

(56) References Cited

U.S. PATENT DOCUMENTS 7,826,786 B2 * 11/2010 Suda et al. ..... 399/346
8,103,207 B2 1/2012 Karasawa et al.

FOREIGN PATENT DOCUMENTS

CN 1938652 A 3/2007
CN 101430533 A 5/2009
JP 6-27860 2/1994
JP 2005-352310 A 12/2005
JP 2006-162667 6/2006
JP 2006-251751 9/2006
JP 2007-219445 A 8/2007

OTHER PUBLICATIONS

Chinese Office Action mailed May 24, 2012 in counterpart Chinese Application No. 201010539320.6.
Office Action for Chinese Patent Application No. 201010539320.6 mailed Feb. 27, 2013.
Notification of Refusal in Japanese Patent Application No. JP 2009-231186 (Jun. 4, 2013).
Chinese Office Action issued in Chinese Patent Application No. 201005393206 on Sep. 10, 2013.
Decision of Refusal in Japanese Patent Application No. 2009-231186, mailed Oct. 1, 2013.
Chinese Office Action dated Jun. 13, 2014 in counterpart Chinese Application No. 201210349543.5.

* cited by examiner

*Primary Examiner* — Hoang Ngo
(74) *Attorney, Agent, or Firm* — Holtz Holtz Goodman & Chick PC

(57) ABSTRACT

A cleaning device, including, a first blade to slidably contact with a surface of an image carrier to which a toner including an external additive adheres, a second blade to slidably contact with the surface of the image carrier and to be provided downstream of the first blade in a rotation direction of the image carrier, and a lubricant applying mechanism section to apply a lubricant to the surface of the image carrier, wherein hardness of the first blade is equal to or more than hardness of the second blade.

8 Claims, 5 Drawing Sheets

FIG.4

*Table 1*

| HARDNESS JIS-A [°] | | CLEANING PERFORMANCE EVALUATION |
|---|---|---|
| FIRST BLADE | SECOND BLADE | |
| 67 | 67 | △ |
| | 70 | × |
| | 72 | × |
| | 75 | × |
| | 77 | × |
| 70 | 67 | ○ |
| | 70 | △ |
| | 72 | × |
| | 75 | × |
| | 77 | × |
| 72 | 67 | ◎ |
| | 70 | ○ |
| | 72 | △ |
| | 75 | × |
| | 77 | × |
| 75 | 67 | ◎ |
| | 70 | ◎ |
| | 72 | ○ |
| | 75 | △ |
| | 77 | × |
| 77 | 67 | ◎ |
| | 70 | ◎ |
| | 72 | ◎ |
| | 75 | ○ |
| | 77 | △ |

FIG.5

*Table 2*

| RESILIENT MODULUS JIS-A [%] | | CLEANING PERFORMANCE EVALUATION |
|---|---|---|
| FIRST BLADE | SECOND BLADE | |
| 21 | 21 | △ |
| | 27 | ○ |
| | 38 | ○ |
| | 41 | ◎ |
| | 50 | ◎ |
| 27 | 21 | × |
| | 27 | △ |
| | 38 | ○ |
| | 41 | ○ |
| | 50 | ◎ |
| 38 | 21 | × |
| | 27 | × |
| | 38 | △ |
| | 41 | ○ |
| | 50 | ○ |
| 41 | 21 | × |
| | 27 | × |
| | 38 | × |
| | 41 | △ |
| | 50 | ○ |
| 50 | 21 | × |
| | 27 | × |
| | 38 | × |
| | 41 | × |
| | 50 | △ |

CLEANING DEVICE AND IMAGE FORMING APPARATUS

BACKGROUND OF THE INVENTION

1. Field of the Invention

The present invention relates to a cleaning device and an image forming apparatus.

2. Description of Related Art

In recent years, there has been an image forming apparatus of an electrophotographic system wherein a residual toner adhering to the surface of an image carrier (e.g., photoreceptor drum etc.), on which a toner image is to be formed, is removed by making a cleaning blade slidably contract with the surface of the image carrier.

For example, Japanese Patent Application Laid-Open Publication No. H 6-27860 discloses a cleaning device equipped with a plurality of cleaning blades to come into press contact with the surface of an image carrier, the cleaning blades being arranged so that the hardness of a cleaning blade arranged downstream in the moving direction of the image carrier is relatively lower than the hardness of a cleaning blade arranged upstream.

Furthermore, Japanese Patent Application Laid-Open Publication No. 2006-162667 discloses a cleaning device for removing the toner remaining on the surface of an image carrier with cleaning blades, the cleaning device provided with two or more cleaning blades made of materials having different resilient modulus respectively, and the two or more cleaning blades simultaneously abutting against the surface of the image carrier to clean the surface.

Furthermore, when performing the removal of residual toner, it is necessary to make it easy to remove the toner adhering to the surface of an image carrier, and to reduce the wear of the image carrier and a cleaning blade.

Accordingly, Japanese Patent Application Laid-Open Publication No. 2006-251751 discloses a technique of applying a lubricant to an image carrier. For example, a technique of removing the toner remaining on the surface of a photoreceptor with a cleaning blade, applying a lubricant to the surface of the photoreceptor, which has become clean, with a brush roller, and smoothing the applied lubricant with a lubricant smoothing blade to form a thin layer of the lubricant, has been disclosed.

A cleaning device, like the one disclosed in Japanese Patent Application Laid-Open Publication No. 2006-251751, aiming at uniformly applying a lubricant to the surface of an image carrier by smoothing the lubricant, however, has the problem of the occurrence of filming. The filming in this case is caused by an external additive, which has been added to the toner, remaining to be removed and sticking to the surface of the image carrier.

SUMMARY OF THE INVENTION

The present invention was made in view of the situation described above, and aims at realizing a cleaning device capable of removing a residual toner and an external additive added to the toner, keeping the state of the surface of an image carrier in a good condition, and reducing the occurrence of bad cleaning.

To achieve at least one of the abovementioned objects, a cleaning device reflecting one aspect of the present invention includes, a first blade to slidably contact with a surface of an image carrier to which a toner including an external additive adheres, a second blade to slidably contact with the surface of the image carrier and to be provided downstream of the first blade in a rotation direction of the image carrier, and a lubricant applying mechanism section to apply a lubricant to the surface of the image carrier, wherein hardness of the first blade is equal to or more than hardness of the second blade.

To achieve at least one of the abovementioned objects, a cleaning device reflecting one aspect of the present invention includes, a first blade to slidably contact with a surface of an image carrier to which a toner including an external additive adheres, a second blade to slidably contact with the surface of the image carrier and to be provided downstream of the first blade in a rotation direction of the image carrier, and a lubricant applying mechanism section to apply a lubricant to the surface of the image carrier, wherein a resilient modulus of the first blade is equal to or less than a resilient modulus of the second blade.

To achieve at least one of the abovementioned objects, an image forming apparatus reflecting one aspect of the present invention includes, an image forming section to form a toner image on an image carrier with a toner including an external additive, a paper conveying section to convey paper, a transfer section to transfer the toner image on the image carrier to the paper conveyed by the paper conveying section, a fixing section to fix the toner image transferred to the paper, and a cleaning device to perform cleaning of the image carrier after the transfer, the cleaning device composed of, a first blade to slidably contact with a surface of the image carrier to which the toner adheres, a second blade to slidably contact with the surface of the image carrier and to be provided downstream of the first blade in a rotation direction of the image carrier, and a lubricant applying mechanism section to apply a lubricant to the surface of the image carrier, wherein hardness of the first blade is equal to or more than hardness of the second blade.

To achieve at least one of the abovementioned objects, an image forming apparatus reflecting one aspect of the present invention includes, an image forming section to form a toner image on an image carrier with a toner including an external additive, a paper conveying section to convey paper, a transfer section to transfer the toner image on the image carrier to the paper conveyed by the paper conveying section, a fixing section to fix the toner image transferred to the paper, and a cleaning device to perform cleaning of the image carrier after the transfer, the cleaning device composed of, a first blade to slidably contact with a surface of the image carrier to which the toner adheres, a second blade to slidably contact with the surface of the image carrier and to be provided downstream of the first blade in a rotation direction of the image carrier, and a lubricant applying mechanism section to apply a lubricant to the surface of the image carrier, wherein a resilient modulus of the first blade is equal to or less than a resilient modulus of the second blade.

BRIEF DESCRIPTION OF THE DRAWINGS

The above and other objects, advantages and features of the present invention will become more fully understood from the detailed description given hereinbelow and the appended drawings which are given by way of illustration only, and thus are not intended as a definition of the limits of the present invention, and wherein:

FIG. 4 is a table showing evaluation results of cleaning performances to a photoreceptor drum, which performances differ according to differences of the hardness between a first blade and a second blade; and FIG. 5 is a table showing evaluation results of cleaning performances to the photoreceptor drum, which performances differ according to differences of resilient modulus between the first blade and the second blade.

DESCRIPTION OF THE PREFERRED EMBODIMENTS

In the following, the embodiments of the present invention will be described in detail with reference to the accompanying drawings.

First, the configuration thereof is described.

Figure 1:
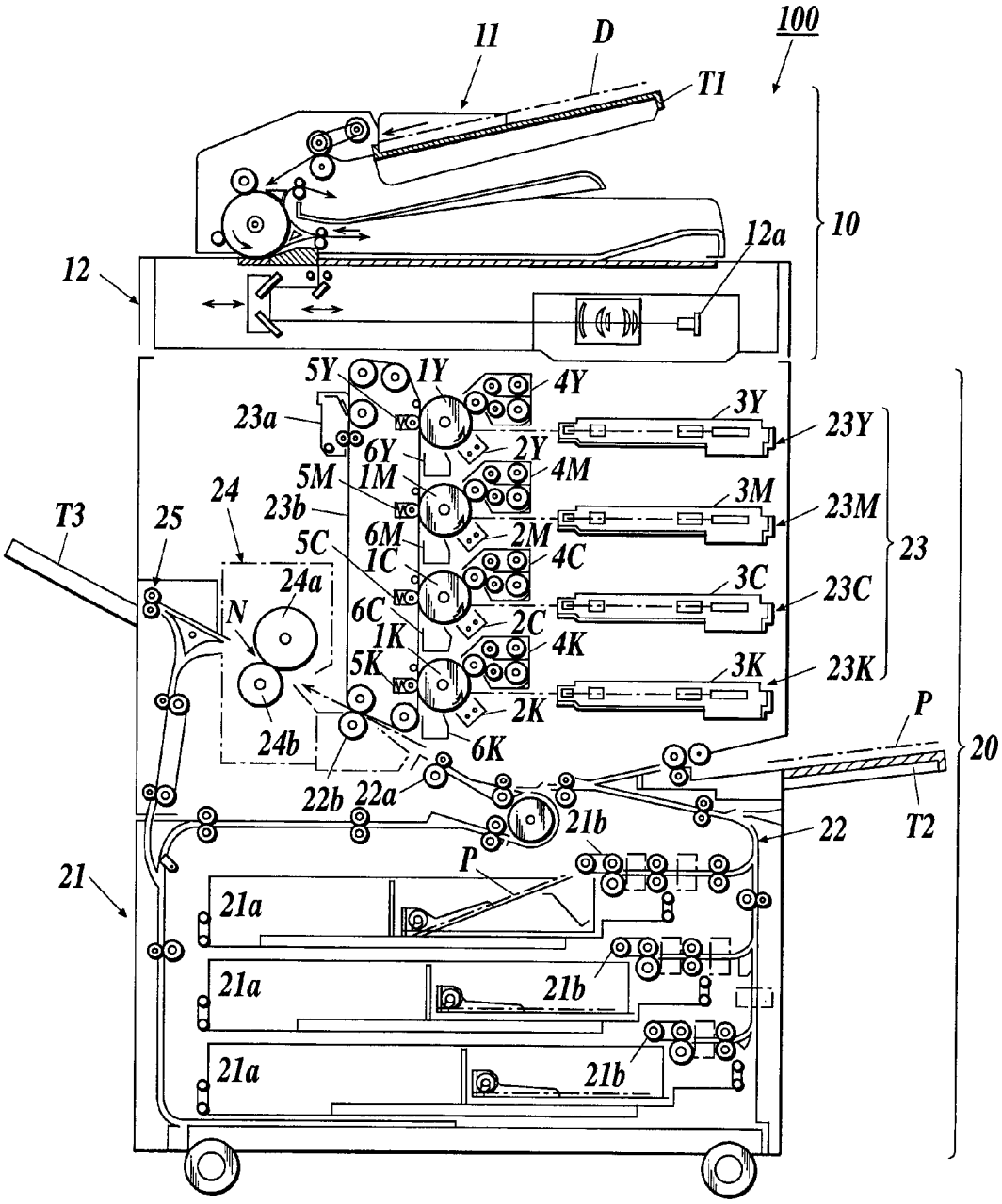
FIG. 1 is a schematic sectional diagram showing the configuration of an image forming apparatus.

FIG. 1 shows a schematic sectional diagram of the configuration of an image forming apparatus 100 of the present embodiment.

As shown in FIG. 1, the image forming apparatus 100 is equipped with a copying function, a printing function, and the like. By the copying function, the image forming apparatus 100 reads an image from an original, performs image formation of the read image on paper P, and outputs the paper P. By the printing function, the image forming apparatus 100 receives a job including page data including image data, the image forming conditions of each image data, and the like, from an external apparatus etc., forms an image on paper P on the basis of the received job, and outputs the paper P. As shown in FIG. 1, the image forming apparatus 100 is composed of an image reading section 10, a printing section 20, and the like.

The image reading section 10 is equipped with an automatic original feeding section 11 called an auto document feeder (ADF) and a reading section 12. The automatic original feeding section 11 is provided on the upper part of the main body of the image forming apparatus 100. The automatic original feeding section 11 is equipped with a plurality of conveyance rollers to convey an original D placed on an original tray T1 to a slit glass, which is a reading surface of the reading section 12.

The reading section 12 is composed of a scanner equipped with a light source, a lens, a contact glass, an image sensor 12*a*, and the like. The reading section 12 reads the image of an original by forming an image by the reflected light of a light radiated to the original D and performing the photoelectric conversion of the formed image, and generates image data (analog signal). The image is not limited to the image data of a figure, a picture, and the like, but includes the text data of a character, a mark, and the like.

The image data read by the image reading section 10 is output to an image processing section (not shown), and is subjected to various kinds of image processing. After that, the image data is subjected to a color separation into each of the colors of yellow (Y), magenta (M), cyan (C), and black (K), and the separated colors are output to the exposing devices 3Y, 3M, 3C, and 3K, respectively, of an image forming section 23.

The printing section 20 is composed of a paper feeding section 21, a fed paper conveying section 22, the image forming section 23, a fixing section 24, and a carrying-out section 25.

The paper feeding section 21 is equipped with a plurality of paper feed trays 21*a*, a plurality of paper feed sections 21*b*, a manual feed tray T2, and the like. Various kinds of paper P, such as standardized paper, specialty paper, and insertion paper, identified by the weight and the sizes etc. of the paper, are stored in each of the paper feed trays 21*a* according to the kinds of paper which are previously set. The paper P stored in the paper feed trays 21*a* is conveyed from their uppermost parts toward the fed paper conveying section 22 one by one by the paper feed sections 21*b*. The manual feed tray T2 can load various kinds of paper P in accordance with user's needs. The paper P loaded on the manual feed tray T2 is conveyed from the uppermost part toward the fed paper conveying section 22 one by one by feed rollers.

In the fed paper conveying section 22, paper P conveyed from the paper feed trays 21*a* or the manual feed tray T2 is conveyed to secondary transfer rollers 22*b* through a plurality of intermediate rollers, resist rollers 22*a*, and the like. Furthermore, the fed paper conveying section 22 conveys paper P that has been subjected to one-side image formation processing to a both-side conveyance path with a conveyance path switching plate, and again conveys the paper P to the secondary transfer rollers 22*b* through the intermediate rollers and the resist rollers 22*a*. By these secondary transfer rollers 22*b*, the toner images transferred onto an intermediate transfer belt 23*b*, described below, are collectively transferred to the paper P.

The image forming section 23 is composed of image forming sections 23Y, 23M, 23C, and 23K, which can severally fill up different color toners T for forming four-color (yellow (Y), magenta (M), cyan (C), and black (K)) images at the maximum, a cleaning section 23*a*, and the intermediate transfer belt 23*b*.

The image forming section 23Y is equipped with a charging device 2Y arranged by a photoreceptor drum 1Y as an image carrier, an exposing device 3Y, a developing device 4Y, a primary transfer roller 5Y, and a cleaning device 6Y, and the image forming section 23Y forms a yellow (Y) image.

To put it concretely, the exposing device 3Y radiates a light according to yellow (Y) image data to the photoreceptor drum 1Y charged by the charging device 2Y to form an electrostatic latent image on the photoreceptor drum 1Y. A yellow (Y) toner T to which an external additive A is added is filled up in the developing device 4Y, and the developing device 4Y makes the charged toner T adhere to the surface of the photoreceptor drum 1Y, with the electrostatic latent image formed thereon, to develop the electrostatic latent image. The photoreceptor drum 1Y, to which the toner T adheres by the developing device 4Y, transfers the toner T to the intermediate transfer belt 23*b* at a transfer position where the primary transfer roller 5Y is arranged while the photoreceptor drum 1Y rotates at a constant speed. After the toner T has been transferred to the intermediate transfer belt 23*b*, the cleaning device 6Y removes the residual charges, the residual toner T, and the like on the surface of the photoreceptor drum 1Y.

The image forming sections 23M, 23C, and 23K severally have a configuration similar to that of the image forming section 23Y, and forms magenta (M), cyan (C), and black (K) images, respectively.

In the following, the photoreceptor drums 1Y, 1M, 1C, and 1K, the charging devices 2Y, 2M, 2C, and 2K, the exposing devices 3Y, 3M, 3C, and 3K, the developing devices 4Y, 4M, 4C, and 4K, the primary transfer rollers 5Y, 5M, 5C, and 5K, and the cleaning devices 6Y, 6M, 6C, and 6K of the respective colors will also be called a photoreceptor drum 1, a charging device 2, an exposing device 3, a developing device 4, a primary transfer roller 5, and a cleaning device 6, respectively.

The intermediate transfer belt 23*b* is a semiconductive endless belt suspended by a plurality of rollers to be rotatably supported, and is driven to be rotated by the rotations of the rollers.

This intermediate transfer belt 23*b* is pressed to the photoreceptor drums 1Y, 1M, 1C, and 1K by the primary transfer rollers 5Y, 5M, 5C, and 5K, of the image forming sections 23Y, 23M, 23C, and 23K, respectively. The toners T of the respective colors developed on the surfaces of the photoreceptor drums 1Y, 1M, 1C, and 1K are, hereby, transferred to the intermediate transfer belt 23*b* at the transfer positions of the primary transfer rollers 5Y, 5M, 5C, and 5K, respectively, and the respective toners T of the yellow, the magenta, the cyan, and the black are transferred to the paper P to be superposed on one another at the transfer position of the secondary transfer rollers 22*b*. Then, after the intermediate transfer belt 23*b* has transferred the toner images onto the paper P by the secondary transfer rollers 22*b*, the paper P is separated from the intermediate transfer belt 23*b* by curvature separation and electrostatic separation, and the cleaning section 23*a* removes residual toners T.

The fixing section 24 is equipped with a heating roller 24*a*, having a heat source, and a pressure roller 24*b* to come into press contact with the heating roller 24*a* to form a nip part N, and the fixing section 24 performs the heat fixing of the toner image transferred onto the paper P.

The paper P on which the toner image is fixed is carried out from a carrying-out port to a copy receiving tray T3 with the paper P being nipped by paper ejecting rollers in the carrying-out section 25.

Figure 2:
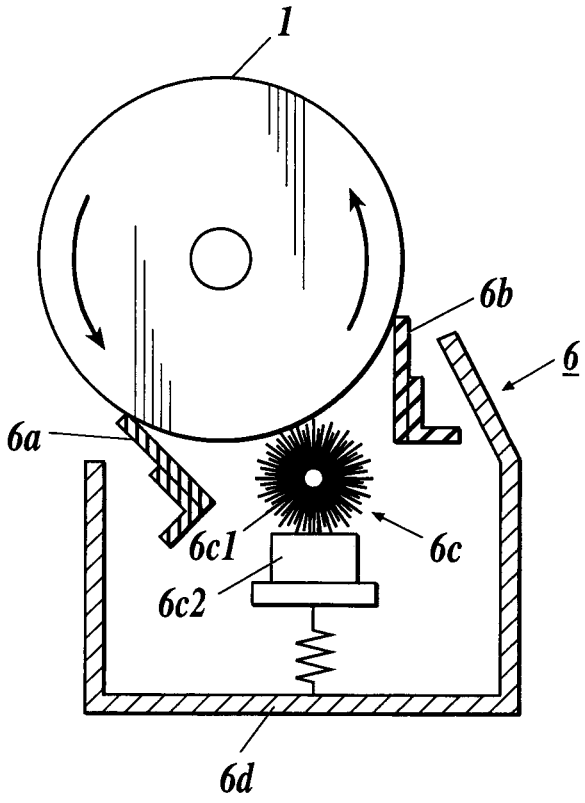
FIG. 2 is an enlarged schematic sectional view of a cleaning device.

FIG. 2 shows an enlarged schematic sectional view of the cleaning device 6.

As shown in FIG. 2, the cleaning device 6 is equipped with a first blade 6*a*, a second blade 6*b*, and a lubricant applying mechanism section 6*c*.

The first blade 6*a* is provided to slidably contact with the surface of the photoreceptor drum 1, to which the toner T including the external additive A, added to the toner T, adheres, with one end of the first blade 6*a* contacting with the surface of the photoreceptor drum 1 from the counter direction of the rotation direction of the photoreceptor drum 1.

The second blade 6*b* is provided downstream of the first blade 6*a* in the moving direction of the toner T adhering to the photoreceptor drum 1, i.e., the rotation direction of the photoreceptor drum 1. The second blade 6*b* is provided to slidably contact with the surface of the photoreceptor drum 1 with one end of the second blade 6*b* contacting with the surface of the photoreceptor drum 1 from the trailing direction of the rotation direction of the photoreceptor drum 1.

The first blade 6*a* and the second blade 6*b* are severally formed in a plate using a material of an elastic body like rubber etc., such as silicon rubber and urethane rubber. The hardness of the first blade 6*a* is equal to or more than that of the second blade 6*b*, and the resilient modulus of the first blade 6*a* is equal to or less than that of the second blade 6*b*.

The lubricant applying mechanism section 6*c* is equipped with a brush roller 6*c*1 and a solid lubricant 6*c*2. The lubricant applying mechanism section 6*c* is provided downstream of the first blade 6*a* and upstream of the second blade 6*b* in the rotation direction of the photoreceptor drum 1.

The brush roller 6*c*1 is provided to abut against the surface of the photoreceptor drum 1 and the solid lubricant 6*c*2. By the rotation of the brush roller 6*c*1, the solid lubricant 6*c*2 is scratched off, and the scratched-off lubricant adheres to the brush roller 6*c*1. Then, the lubricant adhering to the brush roller 6*c*1 adheres to the abutting part of the brush roller 6*c*1 and the photoreceptor drum 1, spreading on the surface of the photoreceptor drum 1.

The solid lubricant 6*c*2 includes a solid hydrophobic material, such as zinc stearate (Zn-St), as the principal component. The solid lubricant 6*c*2 is formed in a plate extending into the rotation axis direction (main scanning direction) of the photoreceptor drum 1. The solid lubricant 6*c*2 is held by a holding member, and is pressed to the brush roller 6*c*1 by a pressurizing member, such as a spring, attached to the housing 6*d* of the cleaning device 6, with the holding member between the solid lubricant 6*c*2 and the pressurizing member.

By the cleaning device 6, the toner T and much of the external additive A that remain on the photoreceptor drum 1 are removed by the first blade 6*a* having high hardness. Because the first blade 6*a* has higher hardness than that of the second blade 6*b*, the adhesion property of the first blade 6*a* to the surface of the photoreceptor drum 1 is weak, and the external additive A remains on the surface of the photoreceptor drum 1. Then, the lubricant is applied to the surface of the photoreceptor drum 1, on which the external additive A remains, by the lubricant applying mechanism section 6*c*. The surface of the photoreceptor drum 1, to which the lubricant is applied and the external additive A remains, slidably contacts with the second blade 6*b*, having lower hardness than that of the first blade 6*a*, and thereby the remaining external additive A is removed. Furthermore, the lubricant applied to the surface of the photoreceptor drum 1 is smoothed to be a uniform thickness.

In the following, the cleaning device according to the present embodiment will concretely be described by giving examples. In addition, the aspects of the present invention are not limited to those examples.

First Example

Cleaning performance evaluations of a plurality of cleaning devices, each of which had two blades, were performed. Two kinds of blade (high hardness blade H and low hardness blade L) were used, each having hardness and a resilient modulus different from each other. The installation positions of the two blades were different among the cleaning devices, and some of the cleaning devices had f the lubricant applying mechanism section and the others did not.

Each of the high hardness blades H had a thickness of 2 mm, a hardness of 72°, a resilient modulus of 50%, and a Young's modulus of 7.4. Each of the low hardness blades L had a thickness of 2 mm, a hardness of 68°, a resilient modulus of 23%, and a Young's modulus of 5.6.

Furthermore, when a blade slidably contacts with the surface of the photoreceptor drum from the counter direction of the rotation direction thereof, the abutting angle between the blade and the surface was set to an angle of from 13° to 15°. On the other hand, when a blade slidably contacts with the surface of the photoreceptor drum from the trailing direction of the rotation direction thereof, the abutting angle was set to an angle of from 5° to 80°.

FIGS. 3A-3F shows schematic configuration diagrams of evaluation models.

Figure 3A:
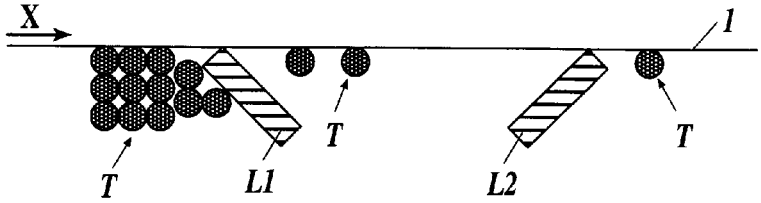
FIG. 3A is a schematic configuration diagram of an evaluation model of a cleaning device using two low hardness blades.

FIG. 3A is an example of a cleaning device using two low hardness blades L1 and L2. The cleaning device shown in FIG. 3A is equipped with the low hardness blade L1 and the low hardness blade L2. The low hardness blade L1 is configured so as to slidably contact with the surface of the photoreceptor drum 1 from the counter direction of the rotation direction X thereof. The low hardness blade L2 is provided downstream of the low hardness blade L1 in the rotation direction X of the photoreceptor drum 1 and is configured so as to slidably contact with the surface of the photoreceptor drum 1 from the trailing direction of the rotation direction X.

In the cleaning device shown in FIG. 3A, when a large quantity of toner T adhered to the surface of the photoreceptor drum 1, the toner T slipped through the low hardness blade L1, and furthermore, the toner T also slipped through the low hardness blade L2.

Because a low hardness blade L has a high adhesion property to the surface of the photoreceptor drum, the low hardness blade L does not allow a toner T to slip through the blade easily. When a large quantity of toner T comes, however, the end of the low hardness blade L where the blade slidably contacts with the surface of the photoreceptor drum 1 is turned up. If the low hardness blade L has once been turned up and a toner T has slipped through the blade, it becomes difficult for the turning of the edge to revert to the original state, and the toner T continuously slips through the blade. In the cleaning device shown in FIG. 3A, hereby, the continuous slipping-through of the toner T was caused, and bad cleaning arose.

Figure 3B:
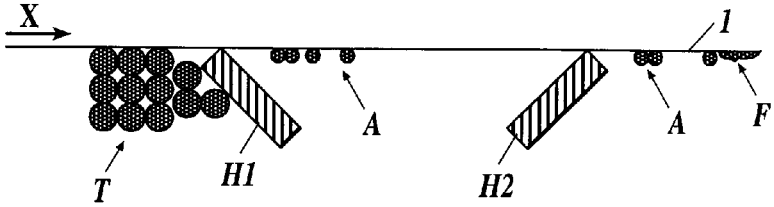
FIG. 3B is a schematic configuration diagram of an evaluation model of a cleaning device using two high hardness blades.

FIG. 3B is an example of a cleaning device using two high hardness blades H1 and H2. The cleaning device shown in FIG. 3B is equipped with the high hardness blade H1 and the high hardness blade H2. The high hardness blade H1 is configured so as to slidably contact with the surface of the photoreceptor drum 1 from the counter direction of the rotation direction X thereof. The high hardness blade H2 is provided downstream of the high hardness blade H1 in the rotation direction X of the photoreceptor drum 1 and is configured so as to slidably contact with the surface of the photoreceptor drum 1 from the trailing direction of the rotation direction X.

In the cleaning device shown in FIG. 3B, when a large quantity of toner T adhered to the surface of the photoreceptor drum 1, an external additive A slipped through the high hardness blade H1, and furthermore, the external additive A also slipped through the high hardness blade H2. Furthermore, the sticking (filming F) of the external additive A that had slipped through the high hardness blade H1 was caused by the high hardness blade H2. Furthermore, because the high hardness blade H2 slidably contacted with the surface of the photoreceptor drum 1 without any toner T between the surface and the high hardness blade H2, the high hardness blade H2 scratched the surface of the photoreceptor drum 1.

Even if the end of a high hardness blade H, which slidably contacts with the surface of the photoreceptor drum 1, turns up, the end of the high hardness blade H, which has turned up, easily reverts to the original state. Consequently, the continuous slipping-through of a toner T can be prevented. However, since the end of the hardness blade repeats the changes between its turning-up state and its original state, the slipping-through of an external additive A, having smaller particle sizes than those of the toner T, is caused. In the cleaning device shown in FIG. 3B, hereby, the slipping-through and the filming F of the external additive A were caused, and bad cleaning arose.

Figure 3C:
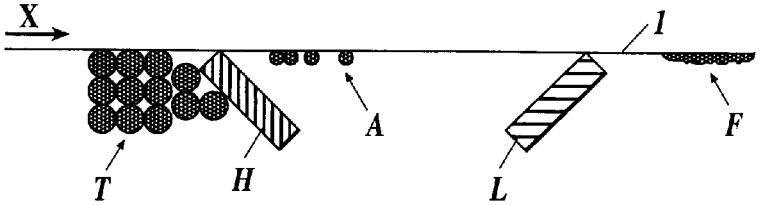
FIG. 3C is a schematic configuration diagram of an evaluation model of a cleaning device using a high hardness blade and a low hardness blade.

FIG. 3C is an example of a cleaning device using a high hardness blade H and a low hardness blade L. The cleaning device shown in FIG. 3C is equipped with the high hardness blade H and the low hardness blade L. The high hardness blade H is configured so as to slidably contact with the surface of the photoreceptor drum 1 from the counter direction of the rotation direction X thereof. The low hardness blade L is provided downstream of the high hardness blade H in the rotation direction X of the photoreceptor drum 1 and is configured so as to slidably contact with the surface of the photoreceptor drum 1 from the trailing direction of the rotation direction X.

In the cleaning device shown in FIG. 3C, when a large quantity of toner T adhered to the surface of the photoreceptor drum 1, the external additive A slipped through the high hardness blade H. Furthermore, the sticking (filming F) of the external additive A that had slipped through the high hardness blade H was caused by the low hardness blade L. Furthermore, because the low hardness blade L slidably contacted with the surface of the photoreceptor drum 1 in the state of closely adhering to the surface without any toner T between the surface and the low hardness blade L, a strain was imposed on the surface of the photoreceptor drum 1.

A high hardness blade H can, as described above, prevent the continuous slipping-through of a toner T, but the slipping-through of an external additive A, having smaller particle sizes than those of the toner T, is caused. Furthermore, a low hardness blade L has a high adhesion property to the surface of the photoreceptor drum 1, and consequently the low hardness blade L makes the slipped external additive A sticking. In the cleaning device shown in FIG. 3C, hereby, the filming F was caused, and bad cleaning arose.

Figure 3D:
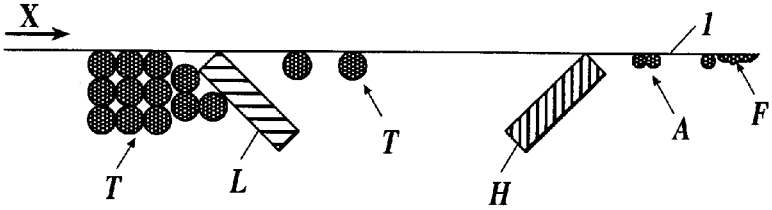
FIG. 3D is a schematic configuration diagram of an evaluation model of a cleaning device using a high hardness blade and a low hardness blade.

FIG. 3D is an example of a cleaning device using a high hardness blade H and a low hardness blade L. The cleaning device shown in FIG. 3D is equipped with the low hardness blade L and the high hardness blade H. The low hardness blade L is configured so as to slidably contact with the surface of the photoreceptor drum 1 from the counter direction of the rotation direction X thereof. The high hardness blade H is provided downstream of the low hardness blade L in the rotation direction X of the photoreceptor drum 1 and is configured so as to slidably contact with the surface of the photoreceptor drum 1 from the trailing direction of the rotation direction X.

In the cleaning device shown in FIG. 3D, when a large quantity of toner T adhered to the surface of the photoreceptor drum 1, the toner T slipped through the low hardness blade L. Furthermore, the external additive A slipped through the high hardness blade H. Furthermore, the sticking (filming F) of the toner T or the external additive A that had slipped through the low hardness blade L was caused by the high hardness blade H.

A low hardness blade L, as described above, allows its end, where the low hardness blade L slidably contacts with the surface of the photoreceptor drum 1, to turn up, which causes continuous slipping-through of a toner T, when a large quantity of toner T comes. Furthermore, a high hardness blade H can, as described above, prevent the continuous slipping-through of a toner T, but causes the slipping-through of an external additive A, having smaller particle sizes than those of the toner T. In the cleaning device shown in FIG. 3D, hereby, the slipping-through and the filming F of the external additive A were caused, and bad cleaning arose.

Figure 3E:
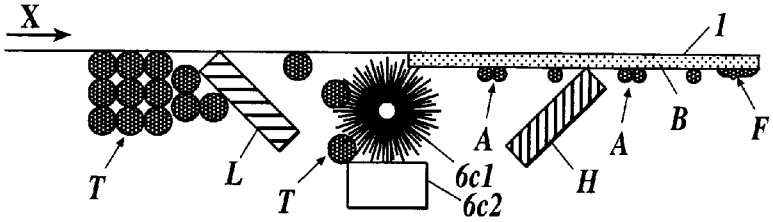
FIG. 3E is a schematic configuration diagram of an evaluation model of a cleaning device using a high hardness blade, a low hardness blade, and a lubricant applying mechanism section.

FIG. 3E is an example of a cleaning device using a high hardness blade H, a low hardness blade L, and the lubricant applying mechanism section 6*c*. The cleaning device shown in FIG. 3E is equipped with the low hardness blade L, the high hardness blade H, and the lubricant applying mechanism section 6*c*. The low hardness blade L is configured so as to slidably contact with the surface of the photoreceptor drum 1 from the counter direction of the rotation direction X thereof. The high hardness blade H is provided downstream of the low hardness blade L in the rotation direction X of the photoreceptor drum 1 and is configured so as to slidably contact with the surface of the photoreceptor drum 1 from the trailing direction of the rotation direction X. The lubricant applying mechanism section 6*c* is provided downstream of the low hardness blade L and upstream of the high hardness blade H.

In the cleaning device shown in FIG. 3E, when a large quantity of toner T adhered to the surface of the photoreceptor drum 1, the toner T slipped through the low hardness blade L. In the lubricant applying mechanism section 6*c*, the toner T, which had slipped through the low hardness blade L, adhered to the brush roller 6*c*1 to be removed, and a lubricant B was applied onto the surface of the photoreceptor drum 1 by the brush roller 6*c*1. The high hardness blade H was not able to remove the external additive A and the slipping-through of the external additive A was caused. Furthermore, the sticking (filming F) of the external additive A that had slipped through the low hardness blade L was caused by the high hardness blade H.

The occurrence of the continuous slipping-through of the toner T owing to the low hardness blade L caused the adherence of the toner T that had slipped through the low hardness blade L to the brush roller 6*c*1 of the lubricant applying mechanism section 6*c*, and consequently the degradation of the lubricant applying performance of the lubricant applying mechanism section 6*c* was caused. As a result, the problem of the lubricant not being uniformly applied was caused. Furthermore, a high hardness blade H can, as described above, prevent the continuous slipping-through of a toner T, but causes the slipping-through of an external additive A, having particle sizes smaller than those of the toner T. In the cleaning apparatus shown in FIG. 3E, hereby, the slipping-through and the filming F of the external additive A were caused, and bad cleaning arose.

Figure 3F:
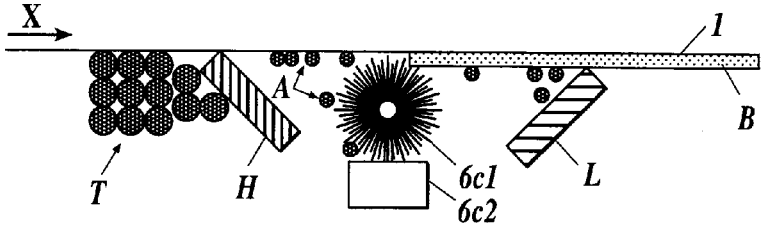
FIG. 3F is a schematic configuration diagram of an evaluation model of a cleaning device using a high hardness blade, a low hardness blade, and a lubricant applying mechanism section.

FIG. 3F shows an example of a cleaning device 6 of the present invention using a high hardness blade H, a low hardness blade L, and the lubricant applying mechanism section 6*c*. The cleaning device shown in FIG. 3F is equipped with the high hardness blade H (corresponding to the first blade 6*a*), the low hardness blade L (corresponding to the second blade 6*b*), and the lubricant applying mechanism section 6*c*. The high hardness blade H is configured so as to slidably contact with the surface of the photoreceptor drum 1 from the counter direction of the rotation direction X thereof. The low hardness blade L is provided downstream of the high hardness blade H in the rotation direction X of the photoreceptor drum 1 and is configured so as to slidably contact with the surface of the photoreceptor drum 1 from the trailing direction of the rotation direction X. The lubricant applying mechanism section 6*c* is provided downstream of the high hardness blade H and upstream of the low hardness blade L.

In the cleaning device shown in FIG. 3F, when a large quantity of toner T adhered to the surface of the photoreceptor drum 1, the external additive A slipped through the high hardness blade H. In the lubricant applying mechanism section 6*c*, the external additive A, which had slipped through the high hardness blade H, adhered to the brush roller 6*c*1 to be removed, and the lubricant B was applied to the surface of the photoreceptor drum 1 by the brush roller 6*c*1. The low hardness blade L slidably contacted with the surface of the photoreceptor drum 1, to which the lubricant B was applied, in the state of closely adhering to the surface, and thereby the external additive A that had not been removed by the brush roller 6*c*1 was removed without imposing any strains on the surface of the photoreceptor drum 1.

A high hardness blade H can, as described above, prevent the continuous slipping-through of toner T, but causes the slipping-through of an external additive A, having particle sizes smaller than those of the toner T. However, the external additive A, that has slipped through the high hardness blade H, is removed by adhering to the brush roller 6*c*1 of the lubricant applying mechanism section 6*c*. Furthermore, because the lubricant B is applied to the surface of the photoreceptor drum 1 by the lubricant applying mechanism section 6*c*, the frictional force between the low hardness blade L and the surface of the photoreceptor drum 1 is reduced, and it becomes easy to remove the external additive A that has not been removed by the brush roller 6*c*1, and thereby, the sticking of the external additive A can be prevented. In the cleaning apparatus shown in FIG. 3F, hereby, no bad cleaning arose.

Consequently, it was ascertained that the following cleaning device had the highest cleaning performance; the cleaning device equipped with, as shown in FIG. 3F, the high hardness blade H, to slidably contact with the surface of the photoreceptor drum 1 from the counter direction in the rotation direction X thereof, the low hardness blade L, provided downstream of the high hardness blade H in the rotation direction X of the photoreceptor drum 1 and provided to slidably contact with the surface of the photoreceptor drum 1 from the trailing direction in the rotation direction X thereof, and the lubricant applying mechanism section 6*c*, provided downstream of the high hardness blade H and upstream of the low hardness blade L.

Second Example

Evaluations of the cleaning performances to the photoreceptor drum 1, which performances differ according to the differences of the hardness and the resilient modulus between the first blade 6*a* and the second blade 6*b*, were performed by using the cleaning device 6 shown in FIG. 2 (FIG. 3F). The existence or nonexistence and the degrees of the occurrence of the slipping-through and the filming F of the toner T and the external additive A were visually observed, and the observation results were regarded as cleaning performance evaluation results.

The first blade 6*a* was formed to have a thickness of 2 mm, a free length of 9 mm, an abutting angle of from 13° to 15°, and a normal line direction weight of 20 N·m. The second blade 6*b* was formed to have a thickness of 2 mm, a free length of 6 mm, and an abutting angle of from 5° to 80°.

The brush roller 6*c*1 of the lubricant applying mechanism section 6*c* was formed to have a particle size of 12 mm, and the core metal thereof was formed to have a particle size of 6 mm. The brush roller 6*c*1 was made of polyamide series synthetic fibers having a density of 100 kF/inch$^2$. The brush roller 6*c*1 ate into the surface of the photoreceptor drum 1 by 1 mm, and rotated at a speed of 70 rpm.

Furthermore, as the solid lubricant 6*c*2, a plate-like solid lubricant formed in a shape of 8 mm×8 mm×330 mm, the principal component of which was zinc stearate (Zn-St), was used. The solid lubricant 6*c*2 was pressed to the brush roller 6*c*1 by a pressurizing member, such as a spring, with a holding member put between the solid lubricant 6*c*2 and the pressurizing member.

In addition, the rotation speed of the photoreceptor drum 1 was 300 mm/s.

A table 1 in FIG. 4 shows evaluation results of the cleaning performances to the photoreceptor drum 1, which performances differ according to the differences of the hardness between the first blade 6*a* and the second blade 6*b*. The criteria of the cleaning performance evaluations are as follows:

Double Circles: no slipping-through of the toner T and the external additive A occurred, and no filming F occurred (excellent);

Circles: slipping-through of the toner T or the external additive A occurred, or filming F occurred, but the degree of the occurrence was very little, and no bad image was caused (good);

Triangles: slipping-through of the toner T or the external additive A occurred, or filming F occurred, but the degree of the occurrence was not the one causing a fatally bad image (acceptable); and Crosses: slipping-through of the toner T and the external additive A occurred, and filming F also occurred, and the degrees of the occurrence were the ones causing fatally bad images including image defects such as the occurrence of streaks in an image, and the like (unacceptable).

As shown in the table 1, it was ascertained that, when the hardness of the first blade 6*a* was equal to or more than the hardness of the second blade 6*b*, no fatally bad images occurred. In particular, when the hardness of the first blade 6*a* was more than the hardness of the second blade 6*b* by 5° or more (in the cases of the combinations of the hardness of the first blades 6*a* and the hardness of the second blades 6*b*, the evaluation results of which were double circles), high cleaning performance was obtained.

A table 2 in FIG. 5 shows evaluation results of the cleaning performances to the photoreceptor drum 1, which performances differ according to the differences of the resilient modulus between the first blade 6*a* and the second blade 6*b*. The criteria of the cleaning performance evaluations are similar to those of the table 1, and the description thereof is omitted.

As shown in the table 2, it was ascertained that, when the resilient modulus of the first blade 6*a* was equal to or less than the resilient modulus of the second blade 6*b*, no fatally bad images occurred. In particular, when the resilient modulus of the first blade 6*a* was less than the resilient modulus of the second blade 6*b* by 20% or more than 20% (in the cases of the combinations of the resilient modulus of the first blade 6*a* and the resilient modulus of the second blade 6*b*, the evaluation results of which were double circles), high cleaning performance was obtained.

As described above, according to the present embodiment, it is possible to remove the toner T and the external additive A added to the toner T to reduce the occurrence of bad cleaning while keeping the state of the surface of the photoreceptor drum 1 in good condition, using the cleaning device equipped with the first blade 6*a*, the second blade 6*b* provided downstream of the first blade 6*a* in the rotation direction X of the photoreceptor drum 1, and the lubricant applying mechanism section 6*c*, the first blade 6*a* having hardness equal to or more than that of the second blade 6*b* or having a resilient modulus equal to or less than that of the second blade 6*b*.

In particular, the external additive A that has slipped through the first blade 6*a* can be removed by providing the lubricant applying mechanism section 6*c* downstream of the first blade 6*a* and upstream of the second blade 6*b*. Moreover, the frictional force between the second blade 6*b* and the surface of the photoreceptor drum 1 can be reduced by applying the lubricant B to the surface of the photoreceptor drum 1 from which the toner T has been removed. Thus, the external additive A that has slipped through the first blade 6*a* can be removed while reducing the strain imposed on the surface of the photoreceptor drum 1 by the second blade 6*b*, and the occurrence of filming F can be prevented.

Furthermore, because the first blade 6*a* slidably contacts with the surface of the photoreceptor drum 1 from the counter direction in the rotation direction X thereof, the first blade 6*a* acts to eat into the surface of the photoreceptor drum 1 and makes it easy to scrape away the toner T from the surface, and consequently the continuous slipping-through of the toner T can be prevented.

Furthermore, because the second blade 6*b* slidably contacts with the surface of the photoreceptor drum 1 from the trailing direction in the rotation direction X thereof, the second blade 6*b* is in the state of being trailed along the rotation direction X of the photoreceptor drum 1, and consequently, the stable removals of the toner T and the external additive A can be realized.

Furthermore, the present invention is not limited to the contents of the embodiment described above, and the contents of the embodiment can suitably be changed without departing from the sprit and the scope of the present invention.

According to a first aspect of the preferred embodiments of the present invention, there is provided a cleaning device 6, including, a first blade 6*a* to slidably contact with a surface of a photoreceptor drum 1 to which a toner T including an external additive A adheres, a second blade 6*b* to slidably contact with the surface of the photoreceptor drum 1 and to be provided downstream of the first blade 6*a* in a rotation direction X of the photoreceptor drum 1, and a lubricant applying mechanism section 6*c* to apply a lubricant B to the surface of the photoreceptor drum 1, wherein hardness of the first blade 6*a* is equal to or more than hardness of the second blade 6*b*.

According to a second aspect of the preferred embodiments of the present invention, there is provided a cleaning device 6, including, a first blade 6*a* to slidably contact with a surface of a photoreceptor drum 1 to which a toner T including an external additive A adheres, a second blade 6*b* to slidably contact with the surface of the photoreceptor drum 1 and to be provided downstream of the first blade 6*a* in a rotation direction X of the photoreceptor drum 1, and a lubricant applying mechanism section 6*c* to apply a lubricant B to the surface of the photoreceptor drum 1, wherein a resilient modulus of the first blade 6*a* is equal to or less than a resilient modulus of the second blade 6*b*.

According to a third aspect of the preferred embodiments of the present invention, there is provided an image forming apparatus 100, including, an image forming section 23 to form a toner image on a photoreceptor drum 1 with a toner T including an external additive A, a paper conveying section 22 to convey paper P, a transfer section to transfer the toner image on the photoreceptor drum 1 to the paper P conveyed by the paper conveying section 22, a fixing section 24 to fix the toner image transferred to the paper P, and a cleaning device 6 to perform cleaning of the photoreceptor drum 1 after the transfer, the cleaning device 6 composed of, a first blade 6*a* to slidably contact with a surface of the photoreceptor drum 1 to which the toner T adheres, a second blade 6*b* to slidably contact with the surface of the photoreceptor drum 1 and to be provided downstream of the first blade 6*a* in a rotation direction X of the photoreceptor drum 1, and a lubricant applying mechanism section 6*c* to apply a lubricant B to the surface of the photoreceptor drum 1, wherein hardness of the first blade 6*a* is equal to or more than hardness of the second blade 6*b*.

According to a fourth aspect of the preferred embodiments of the present invention, there is provided an image forming apparatus 100, including, an image forming section 23 to form a toner image on a photoreceptor drum 1 with a toner T including an external additive A, a paper conveying section 22 to convey paper P, a transfer section to transfer the toner image on the photoreceptor drum 1 to the paper P conveyed by the paper conveying section 22, a fixing section 24 to fix the toner image transferred to the paper P, and a cleaning device 6 to perform cleaning of the photoreceptor drum 1 after the transfer, the cleaning device 6 composed of, a first blade 6*a* to slidably contact with a surface of the photoreceptor drum 1 to which the toner T adheres, a second blade 6*b* to slidably contact with the surface of the photoreceptor drum 1 and to be provided downstream of the first blade 6*a* in a rotation direction X of the photoreceptor drum 1, and a lubricant applying mechanism section 6*c* to apply a lubricant B to the surface of the photoreceptor drum 1, wherein a resilient modulus of the first blade 6*a* is equal to or less than a resilient modulus of the second blade 6*b*.

Accordingly, the cleaning device 6 or the image forming apparatus 100 makes it possible to remove a residual toner T and an external additive A added to the toner T, to keep the state of the surface of a photoreceptor drum 1 in a good condition, and to reduce the occurrence of bad cleaning.

Preferably, the lubricant applying mechanism section 6*c* is provided downstream of the first blade 6*a* and upstream of the second blade 6*b* in the rotation direction X of the photoreceptor drum 1.

Accordingly, the external additive A that has slipped through the first blade 6*a* can be removed. Moreover, the frictional force between the second blade 6*b* and the surface of the photoreceptor drum 1 can be reduced by applying the lubricant B to the surface of the photoreceptor drum 1. Thus, the external additive A that has slipped through the first blade 6*a* can be removed while reducing the strain imposed on the surface of the photoreceptor drum 1 by the second blade 6*b*, and the occurrence of filming F can be prevented.

Preferably, the first blade 6*a* slidably contacts with the surface of the photoreceptor drum 1 from a counter direction of the rotation direction X of the photoreceptor drum 1.

Accordingly, the first blade 6*a* acts to eat into the surface of the photoreceptor drum 1 and makes it easy to scrape away the toner T from the surface, and consequently the continuous slipping-through of the toner T can be prevented.

Preferably, the second blade 6*b* slidably contacts with the surface of the photoreceptor drum 1 from a trailing direction of the rotation direction X of the photoreceptor drum 1.

Accordingly, the second blade 6*b* is in the state of being trailed along the rotation direction X of the photoreceptor drum 1, and consequently the stable removals of the toner T and the external additive A can be realized.

The entire disclosure of Japanese Patent Application No. 2009-231186 filed on Oct. 5, 2009 including description, claims, drawings, and abstract are incorporated herein by reference in its entirety.

Although various exemplary embodiments have been shown and described, the invention is not limited to the embodiments shown. Therefore, the scope of the invention is intended to be limited solely by the scope of the claims that follow.

What is claimed is:

1. A cleaning device, comprising:

a first blade to slidably contact with a surface of an image carrier to which a toner including an external additive adheres;

a second blade to slidably contact with the surface of the image carrier and to be provided downstream of the first blade in a rotation direction of the image carrier; and a lubricant applying mechanism section to apply a lubricant to the surface of the image carrier, wherein hardness of the first blade is more than hardness of the second blade;

the first blade slidably contacts with the surface of the image carrier from a counter direction of the rotation direction of the image carrier;

the second blade slidably contacts with the surface of the image carrier from a trailing direction of the rotation direction of the image carrier; and the lubricant applying mechanism section is provided downstream of the first blade and upstream of the second blade in the rotation direction of the image carrier.

2. The cleaning device according to claim 1, wherein the hardness of the first blade is more than the hardness of the second blade by 5° or more.

3. A cleaning device, comprising:

a first blade to slidably contact with a surface of an image carrier to which a toner including an external additive adheres;

a second blade to slidably contact with the surface of the image carrier and to be provided downstream of the first blade in a rotation direction of the image carrier; and a lubricant applying mechanism section to apply a lubricant to the surface of the image carrier, wherein a resilient modulus of the first blade is less than a resilient modulus of the second blade;

the first blade slidably contacts with the surface of the image carrier from a counter direction of the rotation direction of the image carrier;

the second blade slidably contacts with the surface of the image carrier from a trailing direction of the rotation direction of the image carrier; and the lubricant applying mechanism section is provided downstream of the first blade and upstream of the second blade in the rotation direction of the image carrier.

4. The cleaning device according to claim 3, wherein the resilient modulus of the first blade is less than the resilient modulus of the second blade by 20% or more.

5. An image forming apparatus, comprising:

an image forming section to form a toner image on an image carrier with a toner including an external additive;

a paper conveying section to convey paper;

a transfer section to transfer the toner image on the image carrier to the paper conveyed by the paper conveying section;

a fixing section to fix the toner image transferred to the paper; and a cleaning device to perform cleaning of the image carrier after the transfer, the cleaning device including:

a first blade to slidably contact with a surface of the image carrier to which the toner adheres;

a second blade to slidably contact with the surface of the image carrier and to be provided downstream of the first blade in a rotation direction of the image carrier; and a lubricant applying mechanism section to apply a lubricant to the surface of the image carrier, wherein hardness of the first blade is more than hardness of the second blade;

the first blade slidably contacts with the surface of the image carrier from a counter direction of the rotation direction of the image carrier;

the second blade slidably contacts with the surface of the image carrier from a trailing direction of the rotation direction of the image carrier; and the lubricant applying mechanism section is provided downstream of the first blade and upstream of the second blade in the rotation direction of the image carrier.

6. The image forming apparatus according to claim 5, wherein the hardness of the first blade is more than the hardness of the second blade by 5° or more.

7. An image forming apparatus, comprising: an image forming section to form a toner image on an image carrier with a toner including an external additive;

a paper conveying section to convey paper;

a transfer section to transfer the toner image on the image carrier to the paper conveyed by the paper conveying section;

a fixing section to fix the toner image transferred to the paper; and a cleaning device to perform cleaning of the image carrier after the transfer, the cleaning device including:

a first blade to slidably contact with a surface of the image carrier to which the toner adheres;

a second blade to slidably contact with the surface of the image carrier and to be provided downstream of the first blade in a rotation direction of the image carrier; and a lubricant applying mechanism section to apply a lubricant to the surface of the image carrier, wherein a resilient modulus of the first blade is less than a resilient modulus of the second blade;

the first blade slidably contacts with the surface of the image carrier from a counter direction of the rotation direction of the image carrier;

the second blade slidably contacts with the surface of the image carrier from a trailing direction of the rotation direction of the image carrier; and the lubricant applying mechanism section is provided downstream of the first blade and upstream of the second blade in the rotation direction of the image carrier.

8. The image forming apparatus according to claim 7, wherein the resilient modulus of the first blade is less than the resilient modulus of the second blade by 20% or more.

* * * * *